US011986030B2

(12) United States Patent
Richards

(10) Patent No.: US 11,986,030 B2
(45) Date of Patent: May 21, 2024

(54) KNEE PAD SUPPORT FRAME

(71) Applicant: Lee E. Richards, Whitefield, ME (US)

(72) Inventor: Lee E. Richards, Whitefield, ME (US)

( * ) Notice: Subject to any disclaimer, the term of this patent is extended or adjusted under 35 U.S.C. 154(b) by 435 days.

(21) Appl. No.: 16/559,672

(22) Filed: Sep. 4, 2019

(65) Prior Publication Data

US 2019/0387817 A1 Dec. 26, 2019

Related U.S. Application Data

(63) Continuation of application No. 13/732,640, filed on Jan. 2, 2013, now Pat. No. 10,441,007.

(51) Int. Cl.
*A41D 13/05* (2006.01)
*A41D 13/06* (2006.01)

(52) U.S. Cl.
CPC ..... *A41D 13/0568* (2013.01); *A41D 13/065* (2013.01); *A41D 2600/20* (2013.01)

(58) Field of Classification Search
CPC .... A63B 2071/1258; A63B 2071/1275; A63B 2071/1283; A63B 2071/1266; A41D 13/0568; A41D 13/056; A41D 13/06; A41D 2600/20; A61F 5/0111; A61F 5/0113; A61F 5/0102; A61F 5/0104; A43C 15/12; A43C 19/00
USPC ..... 2/22
See application file for complete search history.

(56) References Cited

U.S. PATENT DOCUMENTS 459,616 A * 9/1891 Von Rohonczy ..... A61F 5/0111 36/89
2,484,494 A * 10/1949 Ferguson ..... A41D 13/0568 2/24
2,565,762 A * 8/1951 Ferguson ..... A41D 13/0568 2/22
2,733,443 A * 2/1956 Holder ..... A41D 13/065 2/22
2,982,968 A * 5/1961 Groot ..... A63B 71/1225 2/22
3,618,598 A * 11/1971 Davis ..... A61F 5/0585 602/27
3,877,077 A * 4/1975 Chapdelaine ..... A63B 71/1225 2/22
4,057,853 A * 11/1977 McLane ..... A41D 17/00 2/22
4,638,509 A * 1/1987 Charron ..... A41D 1/08 2/2.15
4,844,094 A * 7/1989 Grim ..... A61F 5/0111 602/27
4,966,134 A * 10/1990 Brewer ..... A61F 5/0111 128/882
5,455,969 A * 10/1995 Pratson ..... A41D 13/065 2/24

(Continued)

*Primary Examiner* — Katherine M Moran
*Assistant Examiner* — Haley A Smith

(57) ABSTRACT

A support frame for a knee pad has three major components that interlock with each other to form a rigid and strong frame capable of supporting the weight of a person who is working on knees. The three components are molded of a rigid plastic material. The upper component has a knee seat and a strap for wrapping around the leg of the wearer; the lower component has a cuff for wrapping around the wearer's ankle. Fastener devices for attaching the knee pad and the straps to the support frame are either incorporated into or provided on the support frame.

2 Claims, 8 Drawing Sheets

(56) References Cited

U.S. PATENT DOCUMENTS

| | | | | |
|---|---|---|---|---|
| 5,732,411 | A * | 3/1998 | Coleman | A63B 71/1225 2/24 |
| 8,752,214 | B1 * | 6/2014 | Maldonado | A41D 13/0568 2/24 |
| 2003/0154540 | A1 * | 8/2003 | Nishimoto | A63B 71/1225 2/220 |
| 2004/0003447 | A1 * | 1/2004 | Sveilich | A41D 13/065 2/24 |
| 2006/0004310 | A1 * | 1/2006 | Parizot | B29C 39/025 602/5 |
| 2013/0042503 | A1 * | 2/2013 | Larson | A43C 15/066 12/142 T |

* cited by examiner

KNEE PAD SUPPORT FRAME

BACKGROUND INFORMATION

Field of the Invention

The invention relates to a knee pad that is worn by persons who work on their knees, such as, when laying floors. More particularly, the invention relates to a frame for holding the knee pad.

Discussion of the Prior Art

People who professionally lay floors or carpeting, stair treads, and other jobs that require spending a lot of time on one's knees often wear knee pads that include a support frame and a pad that protects not just the knee, but the shin and ankle portions of the leg. An example of such a knee pad with support frame is disclosed in U.S. Pat. Nos. 4,772,071, 4,876,745, and a knee pad in U.S. Pat. No. 7,937,769, whereby this last patent is incorporated herein by reference, in its entirety.

These professional knee pads with support frame are adapted to fit the length dimension of the user's leg. One desire to modify the prior art is to obtain a support frame that is less expensive to manufacture, yet readily adaptable to the desired leg length and knee width of the individual user, and that also provides strength, rigidity, and durability.

BRIEF SUMMARY OF THE INVENTION

The invention, a support frame for a pad to protect a knee, is a molded plastic unit that includes an upper support, a lower support, and a coupling member. The initial intended use of the support frame is as a frame for a knee pad, and particularly, for the knee pad disclosed in U.S. Pat. No. 7,937,769, but this term is not intended to be limiting, because the support frame and pad can be modified to support a limb and corresponding joint of a user, such as a lower arm and an elbow. Thus, reference is made throughout this disclosure to a support frame for a knee pad, but it is understood that the terms that have specific relevance to a knee pad are for readability and may be exchanged for other terms.

The upper support is shaped to accommodate the knee and upper shin portion of the leg and the lower support to accommodate the lower shin portion and the ankle. The coupling member extends through an opening in the upper support and slidingly meshes with the lower support, which are then fastened together with fastening elements, to form the support frame. Various attachment means are incorporated into the frame to secure the knee pad to the frame and to strap the frame plus knee pad to the user's leg.

The three major components of the frame are molded components that have a plurality of grooves and reinforcing ribs to provide a unit that has the desired structural integrity, i.e., the strength, rigidity, and load-bearing capacity needed to provide support and comfort for a person who spends extended periods of time on his or her knees.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
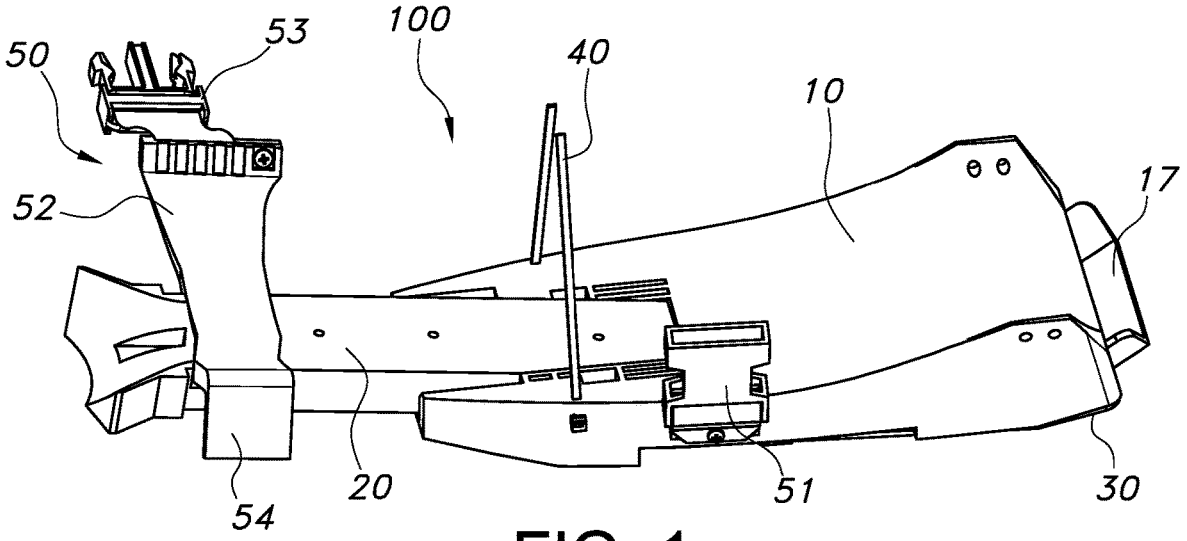
FIG. 1 is a perspective view of a support frame according to the invention for a knee pad.

FIG. 1 is a perspective view of a support frame 100 according to the invention. The embodiment shown is a support frame for a knee pad that is worn by people who work on their knees, for instance, installing flooring, carpeting, stair treads, etc.

Figure 14:
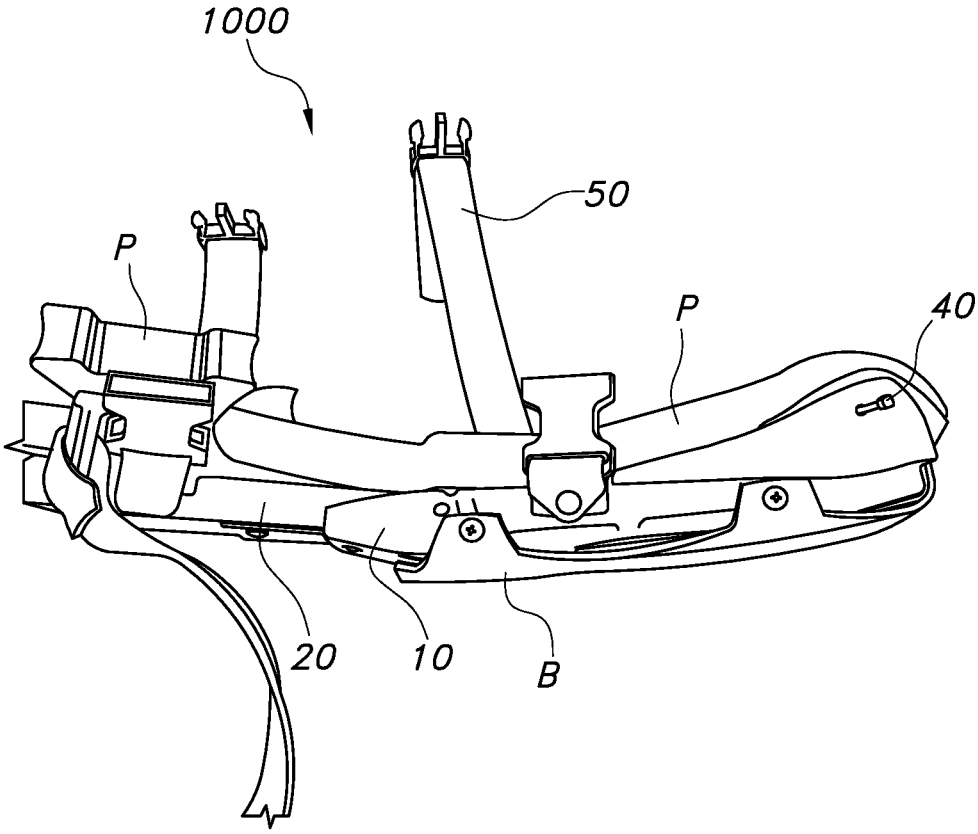
FIG. 14 is a view of the completely assembled product as it is provided to the user.

The support frame 100 comprises a unit assembled from three basic components, an upper support 10, a lower support 20, and a coupling member 30. These components will hereinafter be referred to as a knee support 10, a top shin plate 20, and a bottom shin plate 30, to facilitate reading. Pad attachment means 40 are provided on the frame 100 for securing a knee pad P to the frame and frame attachment means 50 are provided for securing the support frame 100 with the pad P to a user's leg. The figures illustrating the support frame 100 show only a few examples of the pad attachment means 40 and the frame attachment means 50. FIG. 14 shows a complete knee pad or final product 1000, as it is provided to the customer.

Figure 6:
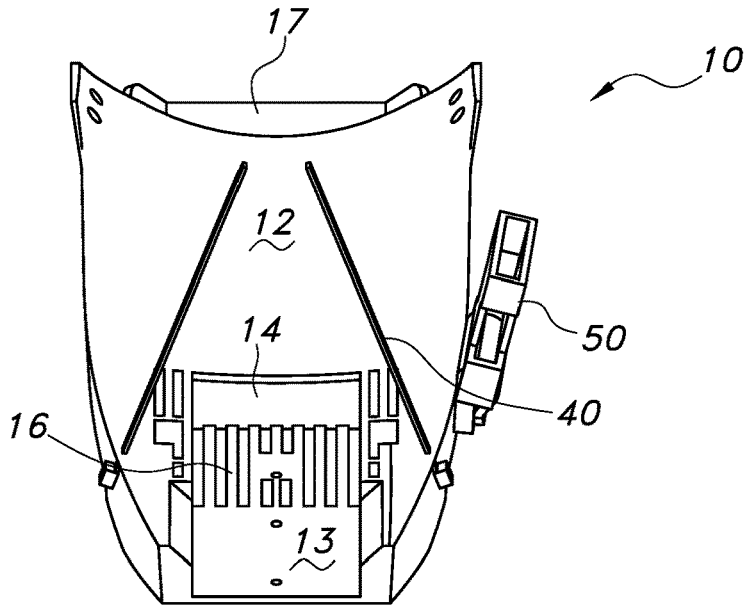
FIG. 6 is a perspective view of the upper support, seen from the coupling end, showing the coupling opening.
Figure 6A:
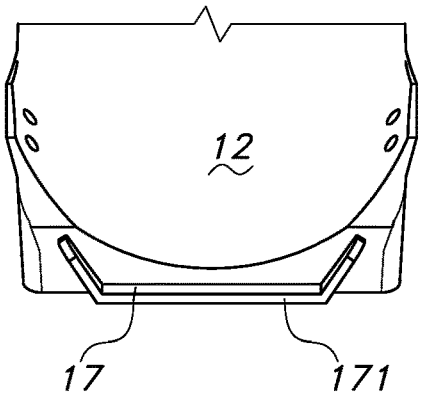
FIG. 6A shows a deflector that extends from the first end of the knee support.

FIGS. 2-6A illustrate the knee support 10, which is a single molded component that has a first end that includes a knee seat 12, a coupling-member support end 13, and a through-way 14 therebetween for receiving the bottom shin plate 30. Reinforcing ribs and recesses 16 are provided on the top and bottom sides of the knee support 10. FIG. 6 shows a perspective view of the knee support 10, taken from the coupling-member support end 13 and illustrating the throughway 14. A deflector 17 extends from the knee seat 12. FIG. 6A shows one part of a fabric hook and loop fastener 171 that has been adhesively applied to the underside of the deflector. Typically, a liner is wrapped over the pad P, to protect it from dirt and wear. The liner is a relatively thin, flexible fabric and its upper portion is wrapped over the deflector 17 and touch-fastened to the fastener 171. The forward portion 10A of the bottom surface of the knee support 10 is formed at a slight angle to allow the wearer to tip forward slightly and walk on his knees. The angle is sufficient to allow the wearer to lift his feet slightly above the floor, to make it easier to maneuver on the floor. In the embodiment shown, the angle of this forward portion 10A is approximately 10.5 degrees. The same angle is reflected in a forward portion 30A of the bottom shin plate 30.

Figure 7:
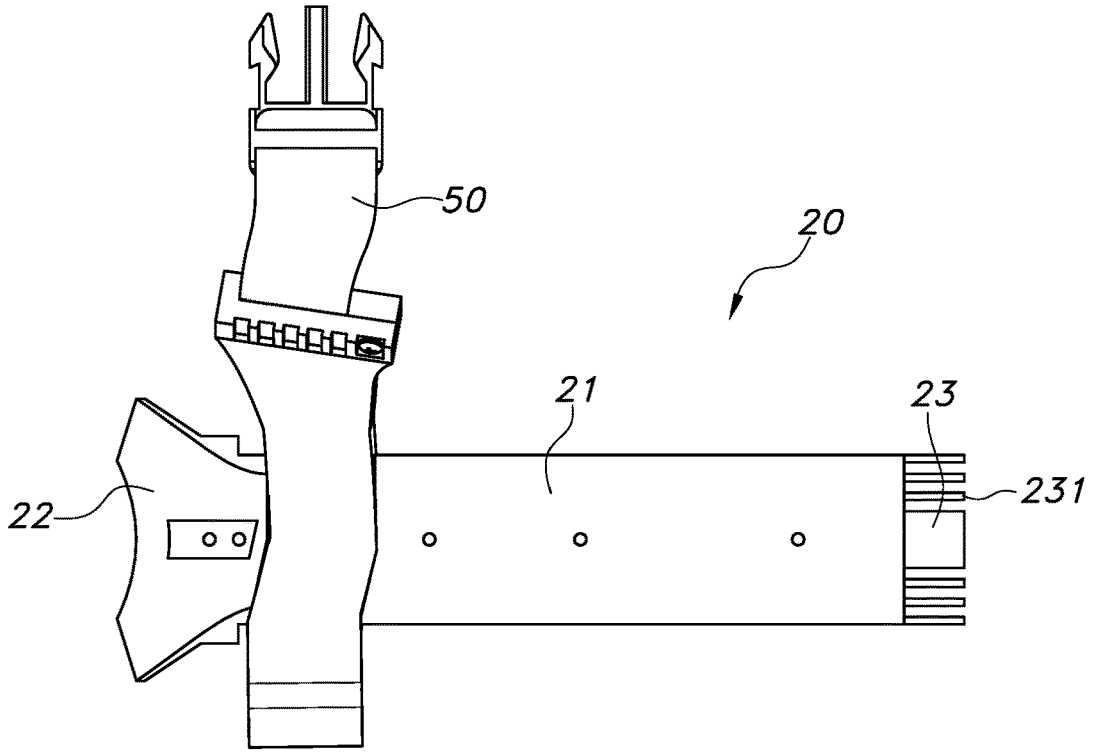
FIG. 7 is a top plan view of the lower support.
Figure 8:
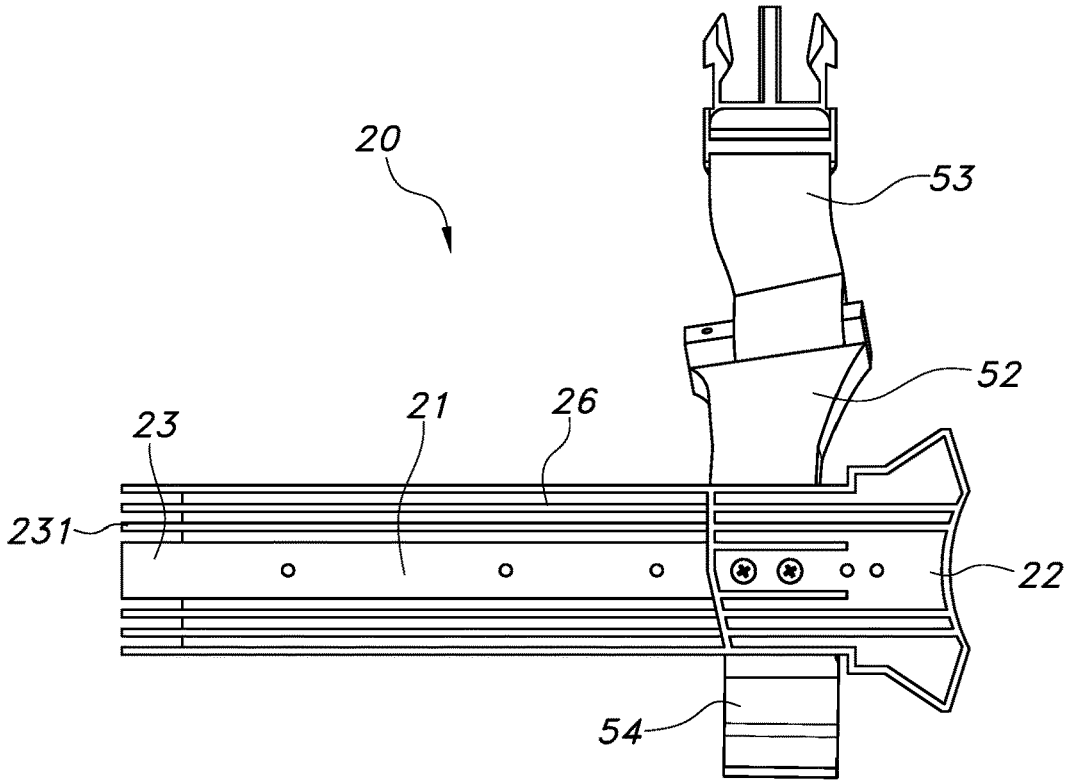
FIG. 8 is a bottom plan view of the lower support.
Figure 9:
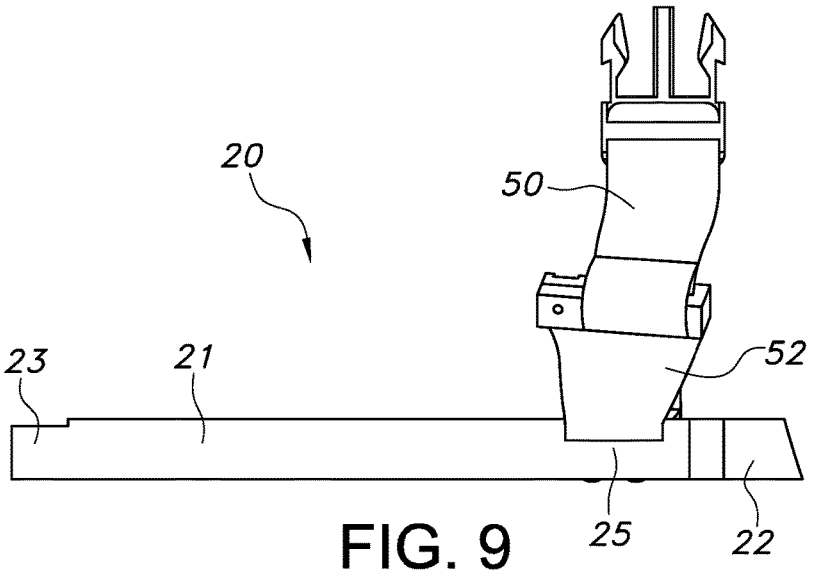
FIG. 9 is a side view of the lower support

FIGS. 7-9 illustrate the top shin plate 20, a molded component shaped to provide support for the knee pad P in the shin area and to protect the ankle area. The top shin plate 20 includes a shin bar 21, an ankle protector 22, and a first coupling end 23. Reinforcing ribs and recesses 26 are provided on the bottom side of the top shin plate. The first coupling end 23 has ribs 231 that extend downward from the top plane of the plate 20.

Figure 10:
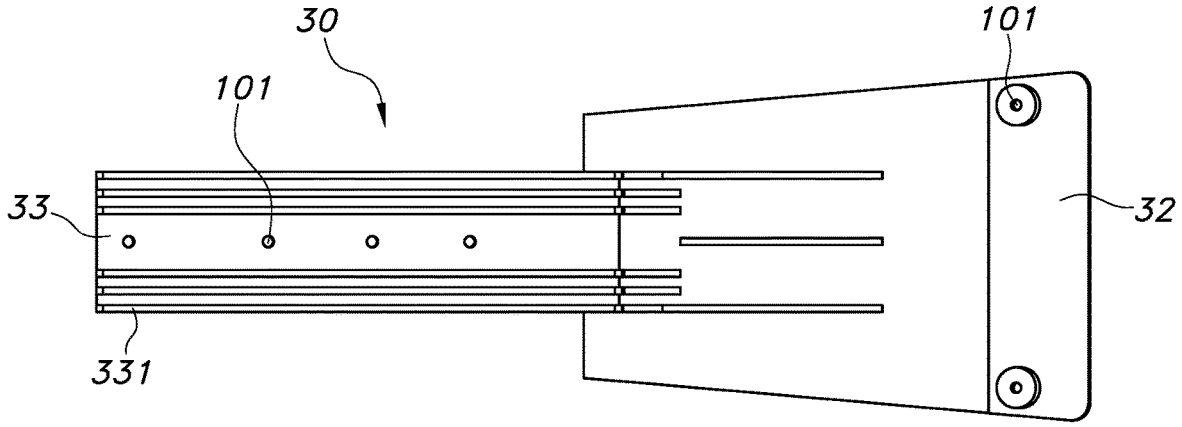
FIG. 10 is a top plan view of the coupling member.
Figure 11:
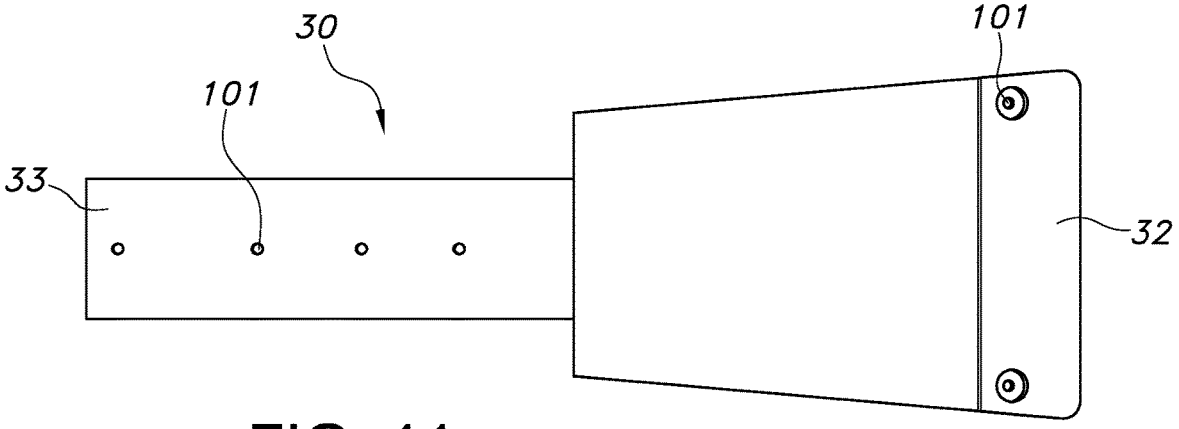
FIG. 11 is a bottom plan view of the coupling member.
Figure 12:
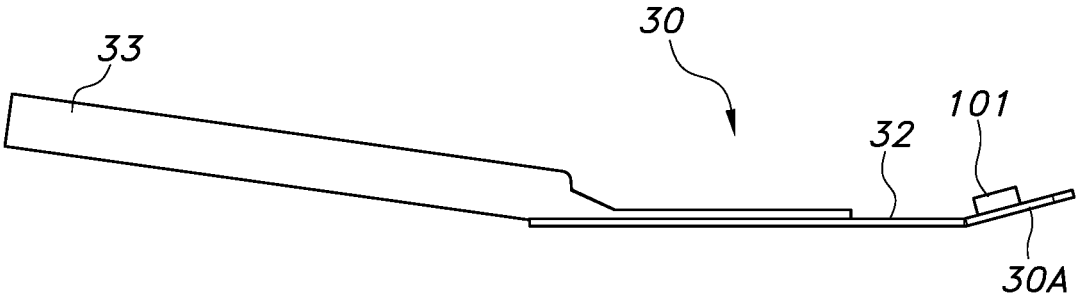
FIG. 12 is a side plan view of the coupling member.

FIGS. 10-12 illustrate details of the bottom shin plate 30. This component, too, is a molded component that includes a knee plate 32 and a second coupling end 33. The knee plate 32 is shaped to correspond to the shape of the underside of the first end of the knee support 10. The second coupling end 33 has ribs 331 that extend upward from the bottom plane of the bottom shin plate and mesh with the ribs 231 of the top shin plate 20. Fastening bores 101 are provided, which are used to fasten the bottom shin plate 30 with the knee support 10 and the top shin plate 20, by means of threaded fasteners, for example.

Figure 13A:
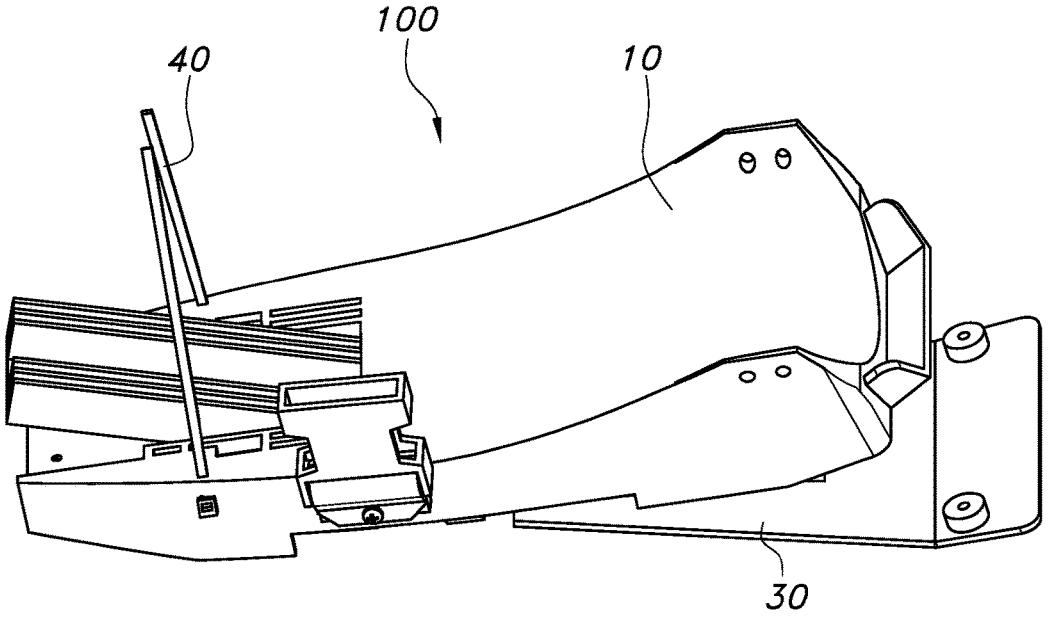
FIG. 13A is a perspective view of the support frame, partially assembled.
Figure 13B:
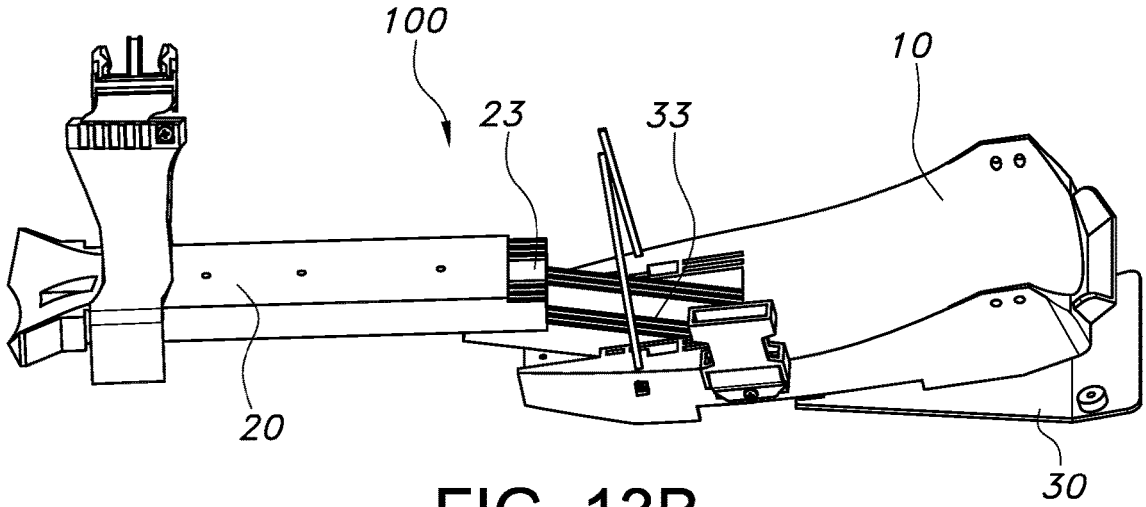
FIG. 13B is a second perspective view of the support frame, partially assembled.
Figure 13C:
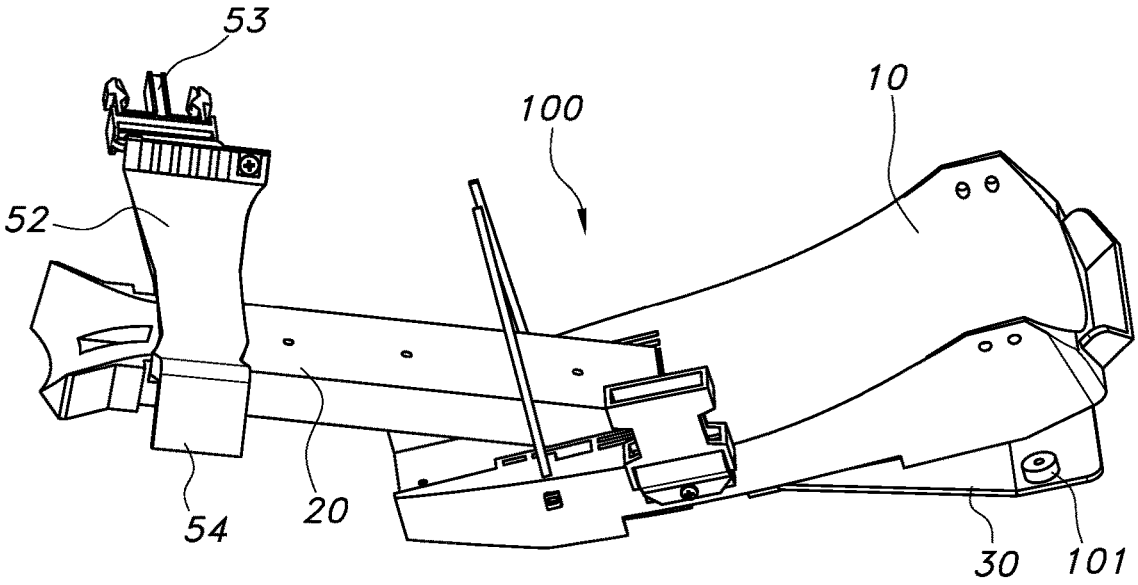
FIG. 13C is a perspective view of the support frame, showing the upper support and the lower support coupled by the coupling member.
Figure 2:
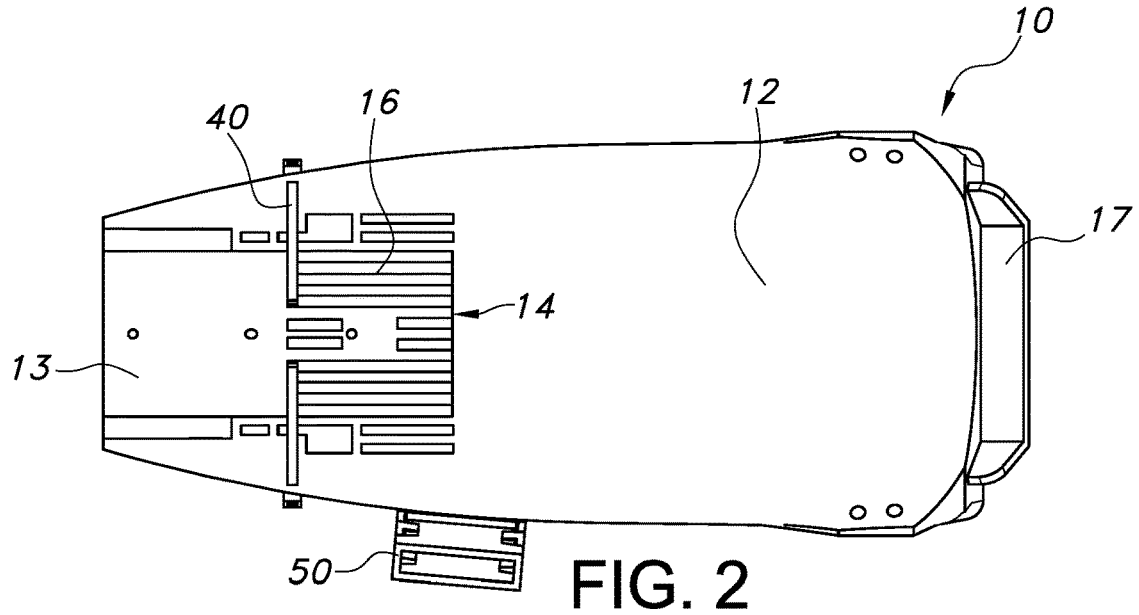
FIG. 2 is a top plan view of the knee support.
Figure 3:
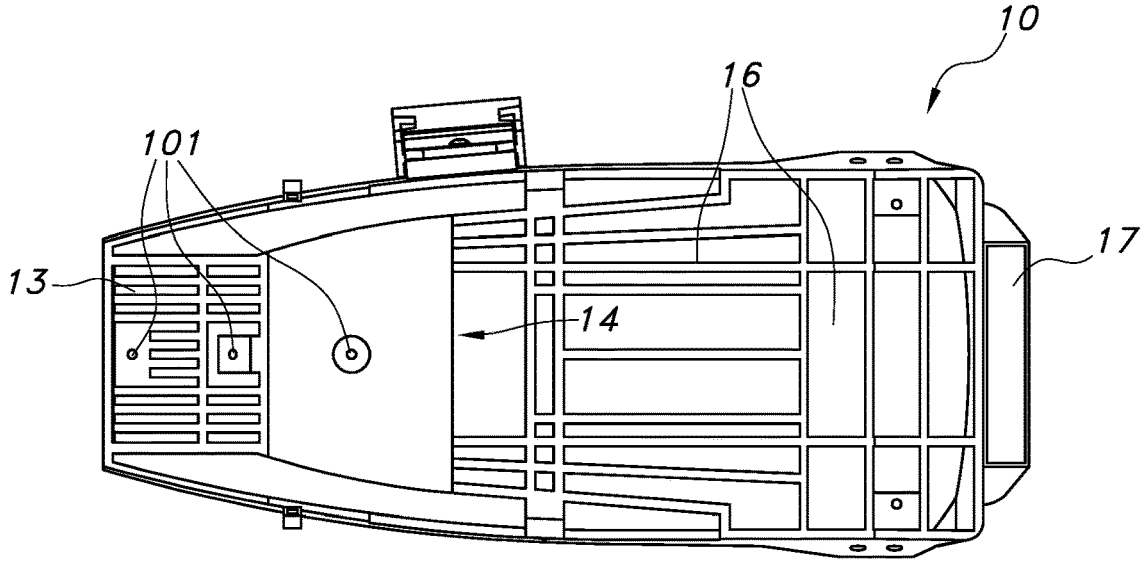
FIG. 3 is a bottom plan view of the upper support.
Figure 4:
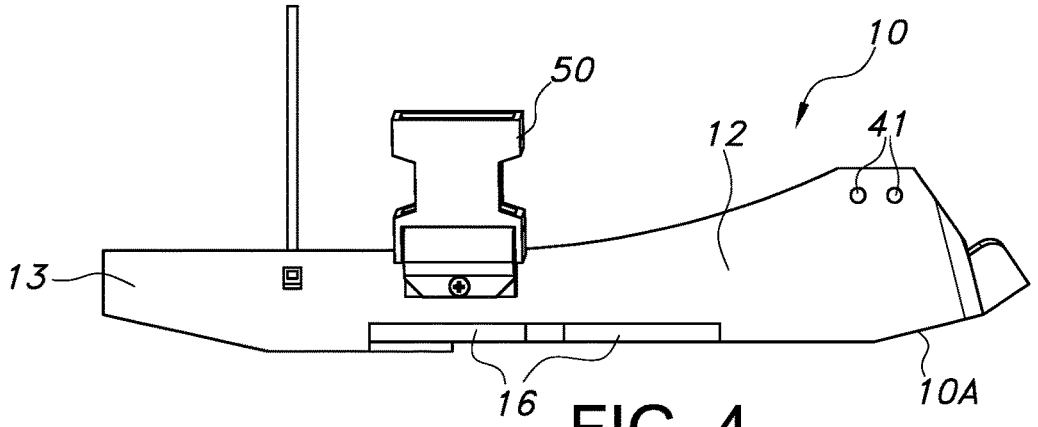
FIG. 4 is a first side plan view of the upper support, showing a buckle attachment.
Figure 5:
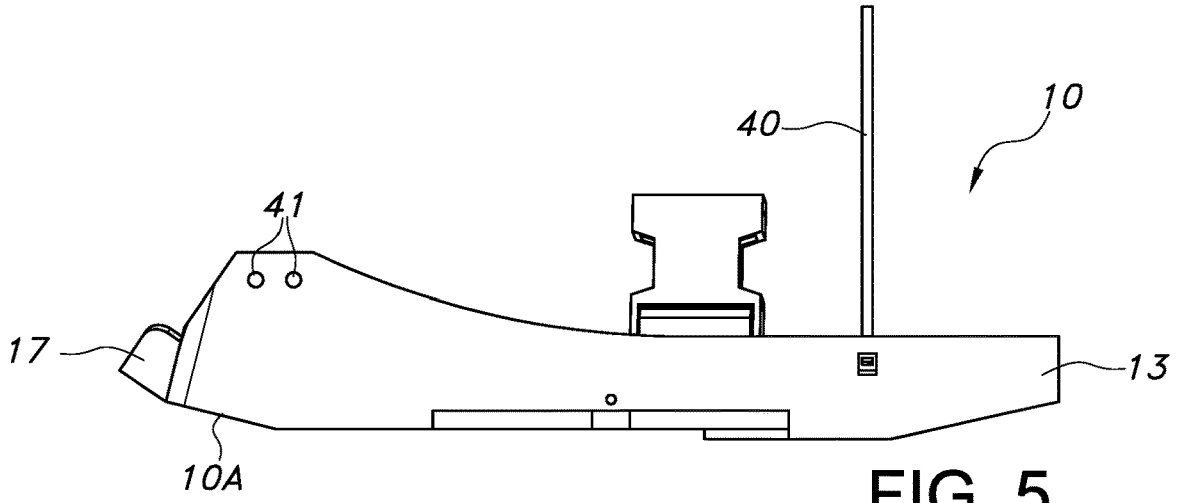
FIG. 5 is a second side plan view of the upper support, showing holes for the pad and boot attachment means.

FIGS. 13A-13C illustrate assembly of the support frame 100. First, the bottom shin plate 30 is inserted through the through-way 14 so that the coupling end 33 extends toward the coupling-member support end 13 of the knee support 10, with the coupling fins 331 extending upward. The coupling end 23 of the top shin plate 20 is coupled with the bottom shin plate by meshing the coupling fins 231 with the fins 331 of the bottom shin plate 30 and sliding the top shin plate in toward the through-way 14. FIG. 13C shows the three components 10, 20, 30 of the support frame 100 coupled together. The coupling end 33 of the bottom shin plate 30 is now covered by the shin bar portion 21. The knee plate 32 of the bottom shin plate 30 has yet to be pushed into place against the underside of the knee support 10. Fastening bosses 101 have been provided on the components 10, 20, 30 for receiving fasteners (not shown), which are used to fasten all three components together.

The top and bottom shin plates 20, 30 may be prefabricated to different lengths, in order to assemble the support frame 100 that is adapted to the length of the leg of the individual user. It is also possible to make the plates 20, 30 a standard length, and to cut one or both of them to the desired length when assembling the support frame 100 for a particular customer. The knee support 10 may be manufactured in two or more sizes to accommodate the width of the knee of the individual user. For example, three sizes S/M/L may be kept in stock, so as to provide the appropriate width when assembling a final product 1000 for a customer.

FIG. 14 illustrates a complete knee pad 1000 that includes the support frame 100, the knee pad P, and the boot B. A liner that is typically used to protect the pad P is not shown. The user has placed an order for a knee pad and given dimensions for the leg length and knee width. The support frame 100 has been assembled according to the dimensions, a knee pad P fastened to the upper side of the frame, and a boot B fastened to the underside of the frame. U.S. Pat. No. 7,937,769 discloses details of the knee pad P, boot B, and liner L, all of which are incorporated herein by reference.

The frame attachment means 50 includes an ankle cuff 52 that has a live hinge 54 at one end for anchoring a buckle and a strap 53 with buckle end attached to the other end. See FIG. 13C. The cuff 52 is preferably made of a thermoplastic material, such as urethane, with a suitable durometer to provide some flexibility, so that the cuff is adaptable to the contour of the wearer's leg when it is strapped on, yet stiff enough, so that it pre-forms the pad P that is attached to the frame 100, to facilitate strapping the frame with pad to the leg. Other suitable materials may also be used, such as leather, woven materials, such as a rugged canvas, rubber, or rubber-like materials. A buckle is slipped over the end of the live hinge, which is then folded to the cuff and fastened to form the buckle anchor. The cuff 52 is an improvement over the prior art, which was simply a strap attached directly to the frame. The cuff acts to protect the ankle extensions or strap ears on the pad P, which can get caught on things and be torn or damaged and to prevent rotation of the pad on the leg.

Figure 15:
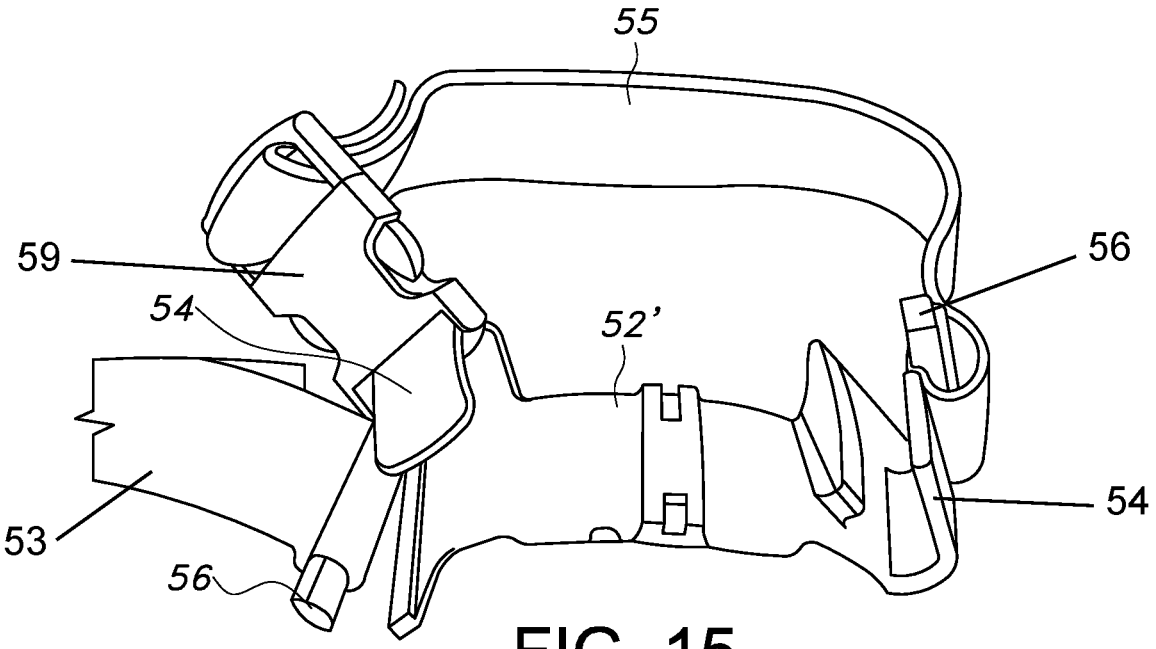
FIG. 15 shows the stirrup cuff.
Figure 16:
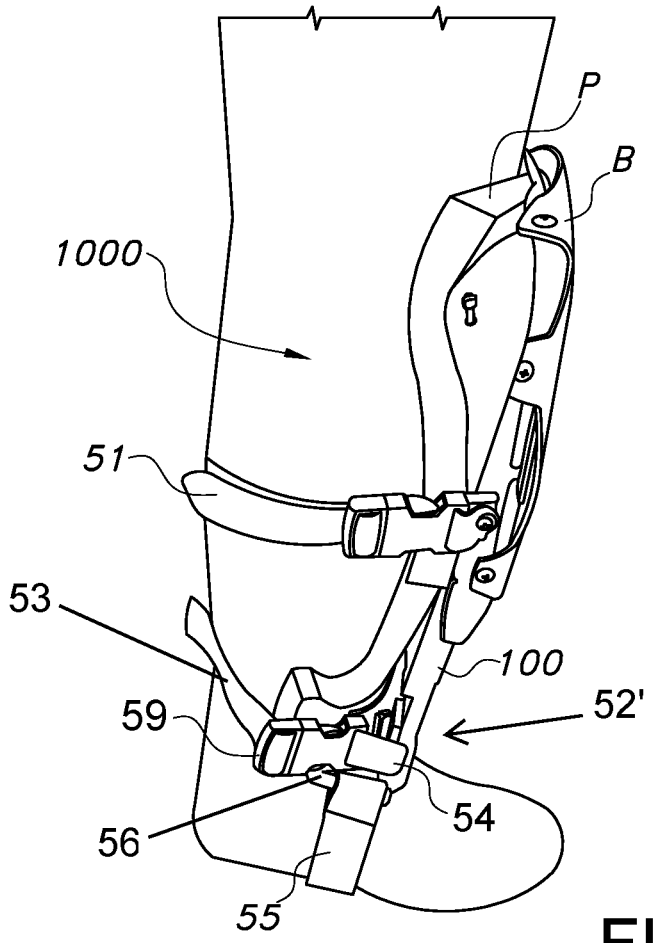
FIG. 16 shows the completely assembled product with stirrup cuff strapped to leg of a user.

FIG. 15 illustrates an alternative cuff 52' which, like the primary embodiment has a first end and a second end, but that is constructed to accommodate an additional stirrup strap 55 that extends under and around the user's foot. The alternative cuff 52' also includes the ankle strap 53 that is described in the primarily embodiment, the ankle strap extending around the lower shin area below a user's calf muscle. The final product 1000 shown in FIG. 16 is assembled with this alternative cuff.

Together the ankle strap 53 and the stirrup strap 55 provide a two-point attachment mechanism that secures the full length of the frame in a manner that does not allow rotation about a user's leg and that does not allow an upward pull on the frame along a user's leg. This two-point attachment mechanism effectively secures the frame in the desired position, both horizontally and vertically, as a user moves about in any conventional work situation, whether that be on a flat floor or an angled roof.

The live hinges 54 for the buckles 59, also referred to as live hinge buckle extension anchors 54, have not yet been fastened in this illustration. The cuff 52' has live hinge sleeve extension anchors 56 and the straps 53, 55 have looped ends that are slipped over these sleeve extension anchors 56. Each side of the cuff 52' includes one live hinge buckle extension anchor 54 for attachment of a buckle 59 and one live hinge sleeve extension anchor 56 for securing a strap 53, 55, with one set of buckle extension anchors 54 and sleeve extension anchors 56 having an approximately vertical orientation for securing the stirrup strap 55 and the other set having an approximately horizontal orientation for securing the ankle strap 53.

As with the primary embodiment, The alternative cuff 52' is preferably made of a thermoplastic material, such as urethane, with a suitable durometer to provide some flexibility, so that the alternative cuff 52' is adaptable to the contour of the wearer's leg when it is strapped on, yet stiff enough, so that it pre-forms the pad P that is attached to the frame 100, to facilitate strapping the frame with pad to the leg. The cuff 52' is preferably a single molded component that reduces the number of parts needed and the time required to assemble the component, thus reducing the cost of manufacturing. Other suitable materials may also be used, such as leather, woven materials, such as a rugged canvas, rubber, or rubber-like materials.

The concept of the support frame 100 according to the invention provides the user with a knee pad 1000 that is the correct length and width. The components are inexpensive, the assembly process is simple, yet the knee pad 1000 functions as a solid unit, with greater stability and load-bearing capacity than conventional knee pads.

It is understood that the embodiments described herein are merely illustrative of the present invention. Variations in the construction of the support frame may be contemplated by one skilled in the art without limiting the intended scope of the invention herein disclosed and as defined by the following claims.

What is claimed is:

1. A cuff adapted to secure a support frame to a user's shin and foot, the support frame having an inner side and outer side, the inner side configured to face the user's shin and foot, the cuff comprising:

a cuff top edge, a cuff bottom edge, a first cuff end and a second cuff end, the first cuff end configured to extend out from one side of the support frame and the second cuff end configured to extend out from an opposite side of the support frame, the first cuff end including as integral components a first buckle anchor and a first sleeve anchor, each of the first buckle anchor and first sleeve anchor substantially oriented towards the cuff top edge, the second cuff end including as integral components a second buckle anchor and a second sleeve anchor, of the second buckle anchor and second sleeve anchor substantially oriented towards the first cuff end or the second cuff end;

each of the first buckle anchor and the second buckle anchor extending out and away from the first cuff end and second cuff end, respectively, the first buckle anchor curved towards the top cuff edge, the second buckle anchor curved towards a middle of the cuff;

each of the first buckle anchor and the second buckle anchor configured in the approximate U-shape having a first end that is an integral part of the cuff and a second end that is located apart from the cuff such that an open space exists between the second end and the cuff;

each of the first sleeve anchor and the second sleeve anchor configured in the approximate shape of a rod each of the rods having an end that is accessible to the first securing strap or second securing strap;

a first securing strap having a first end that includes a first buckle and a second end that has a loop, the first buckle configured to couple to the first buckle anchor to form a first live hinge and the first securing strap's second end configured to loop over the second sleeve anchor, the first securing strap secured in an approximately horizontal orientation and configured to extend around the user's shin;

a second securing strap having a first end that includes a second buckle and a second end that has a loop, the second buckle configured to couple to the second buckle anchor to form a live hinge and the second securing strap's second end configured to loop over the first sleeve anchor, the second securing strap secured in an approximately vertical orientation and configured to extend around the user's foot; and the first securing strap configured to extend around the user's shin and the second securing strap configured to extend around the user's foot and adapted to secure the support frame in both the vertical and horizontal directions.

2. The cuff of claim 1, wherein the cuff is a molded plastic component.

* * * * *